US005836478A

United States Patent [19]

Weiss

[11] Patent Number: 5,836,478

[45] Date of Patent: Nov. 17, 1998

[54] BATTERY DISPENSER

[75] Inventor: James Weiss, Clemston, Fla.

[73] Assignee: Atico International USA, Inc., Ft. Lauderdale, Fla.

[21] Appl. No.: 807,419

[22] Filed: Feb. 28, 1997

[51] Int. Cl.[6] ..... B65D 5/72

[52] U.S. Cl. ..... 221/309; 221/305; 221/155; 229/122.1

[58] Field of Search ..... 221/155, 305, 221/307, 309; 229/122.1

[56] References Cited

U.S. PATENT DOCUMENTS

| | | | |
|---|---|---|---|
| 902,347 | 10/1908 | Tillinghast | 229/122.1 |
| 1,041,192 | 10/1912 | Tarbell | 221/155 |
| 1,898,056 | 2/1933 | Johnson | 229/122.1 |
| 1,973,867 | 9/1934 | Cook | 221/155 |
| 2,299,027 | 10/1942 | Novak | 229/122.1 |
| 3,300,115 | 1/1967 | Schauer | 221/305 |
| 3,332,594 | 7/1967 | De Capua | 221/309 |

*Primary Examiner*—William E. Terrell
*Assistant Examiner*—Patrick Mackey
*Attorney, Agent, or Firm*—Corbin & Gittes

[57] ABSTRACT

A battery dispenser that includes a container that has a face. The face has two edges that extend between sidewalls and between which is defined an aperture. The aperture may be of variable dimension such that a spacing between the two edges at one location is smaller than a diameter of the battery contained within the container. By concentrating manual forces at one of the edges, however, that one edge flexes to permit manual removal of the battery by grasping the ends of the battery via recess openings in the sidewalls that are adjacent to and in communication with the aperture. Preferably, the two edges are each curved with the widest spacing between the two edges being at the sides and the smallest spacing between the two edges being at the center.

5 Claims, 6 Drawing Sheets

30
25
20
22

BATTERY DISPENSER

BACKGROUND OF THE INVENTION

1. Field of the Invention

The present invention relates to a package that dispenses batteries one at a time.

2. Discussion of Related Art

Batteries that are AA or AAA are typically packaged by enclosing them in a molded plastic with cardboard backing. Accessing the batteries requires creating an opening large enough to take out the batteries and may result in destruction of the backing, plastic or both. The result is a torn package that, if tilted, allows the batteries to fall out.

If only some of the batteries need be used at a given time by the consumer, the torn package makes a poor storage depository for the remaining batteries because of the risk of them falling out if the torn package is turned over.

It would be desirable to provide a battery package that dispensed the batteries one at a time and yet prevented the batteries from falling out if the package is tilted.

SUMMARY OF THE INVENTION

One aspect of the invention relates to a battery dispenser that includes a container that has a face. The face has two edges that extend between sidewalls and between which is defined an aperture. The aperture may be of variable dimension such that a spacing between the two edges at one location is smaller than a diameter of the battery contained within the container. By concentrating manual forces at one of the edges, however, that one edge flexes to permit manual removal of the battery by grasping the ends of the battery via recess openings in the sidewalls that are adjacent to and in communication with the aperture. Preferably, the two edges are each curved with the widest spacing between the two edges being at the sides and the smallest spacing between the two edges being at the center.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
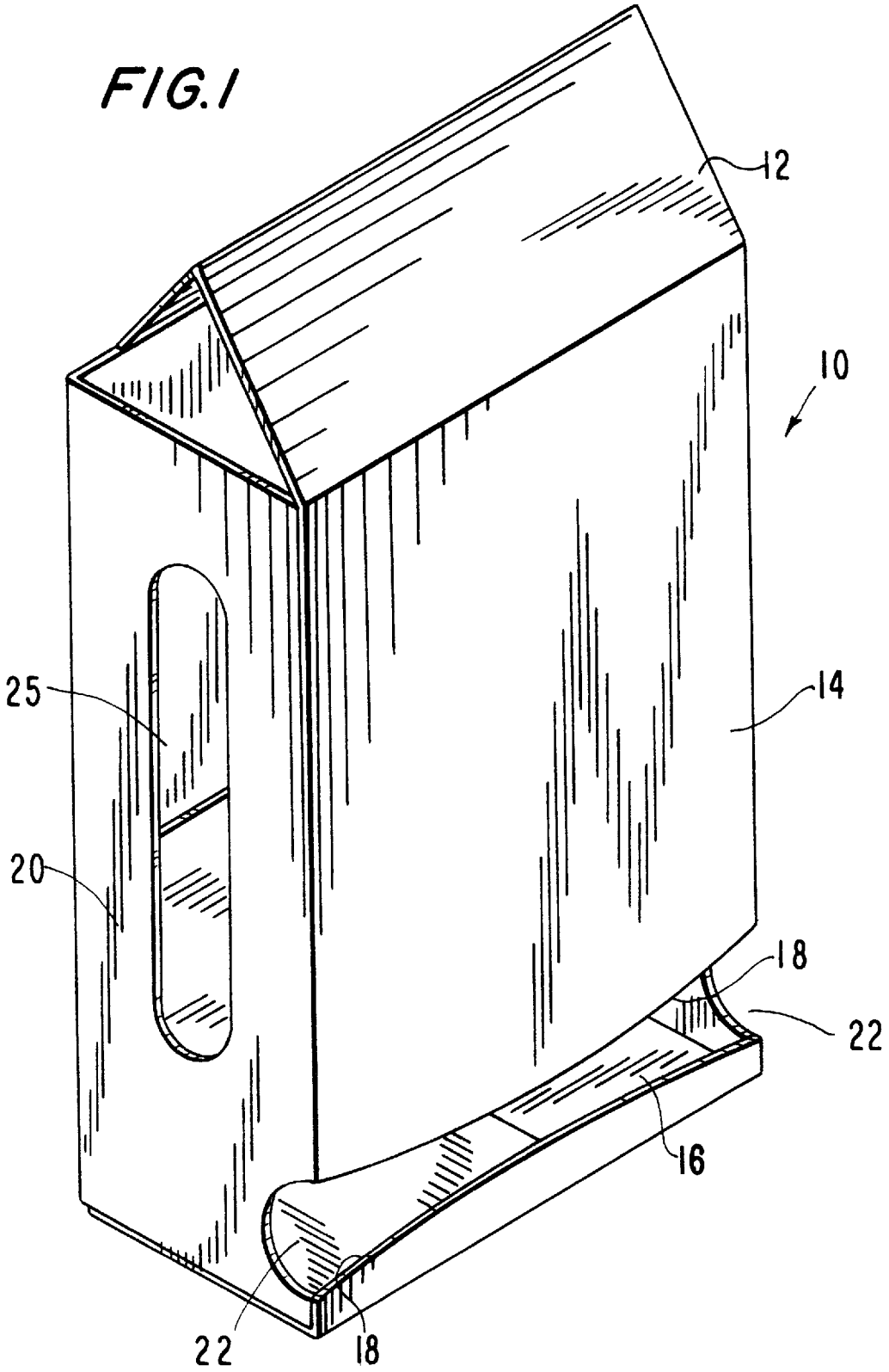
FIG. 1 is a perspective view of the battery dispenser in accordance with the invention.
Figure 2:
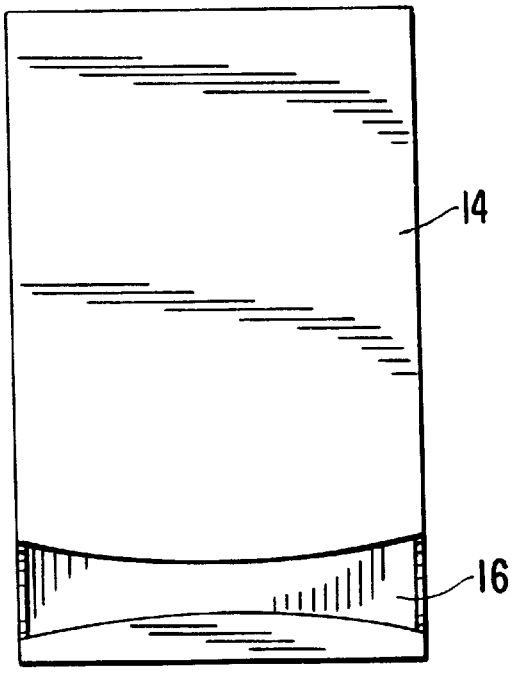
FIG. 2 is a front view thereof.
Figure 3:
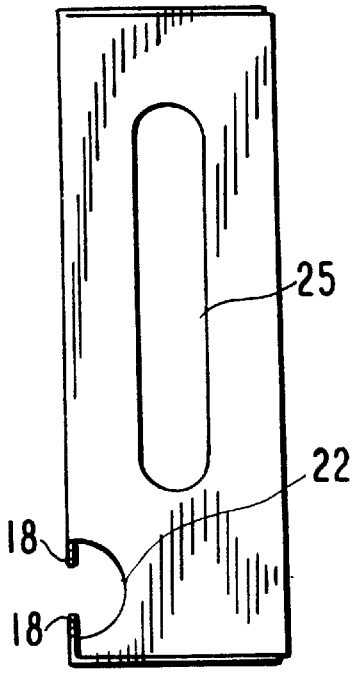
FIG. 3 is a left side view thereof the is identical/symmetric to the right side view thereof.
Figure 4:
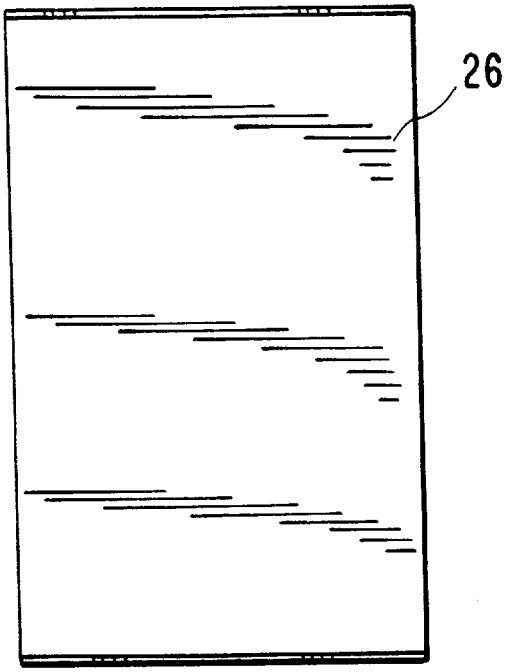
FIG. 4 is a back view thereof.
Figure 5:
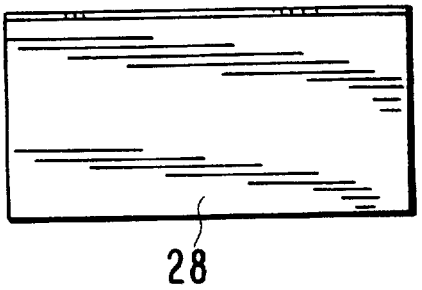
FIG. 5 is a top view thereof that is identical/symmetric to the bottom view thereof.

FIGS. 1–5 show a dispenser 10 with a lid 12. A face 14 has an aperture 16 running the full width of the face between two edges 18 and defining a semicircular curved shape at the adjoining side walls 20. Preferably, the two edges are curved so as to define a spacing at the sides that is larger than that at the center. Since these edges are free, they flex in response to the application of a concentration of manual forces against their edges. In the absence of such manual forces, the face has a natural tendency to bow or concavely curve and stay in that position.

The lid 12 is opened to insert AA or AAA batteries until the box is full. When a battery is wanted, one grasps the ends of the battery visible through the aperture through the recesses 22 in the sidewalls and the battery is pulled through the aperture between the two edges 18 of the front face 14. The front face 14 flexes in response to a concentration of forces being applied to its curved edge to allow the battery to emerge from the container.

Figure 6:
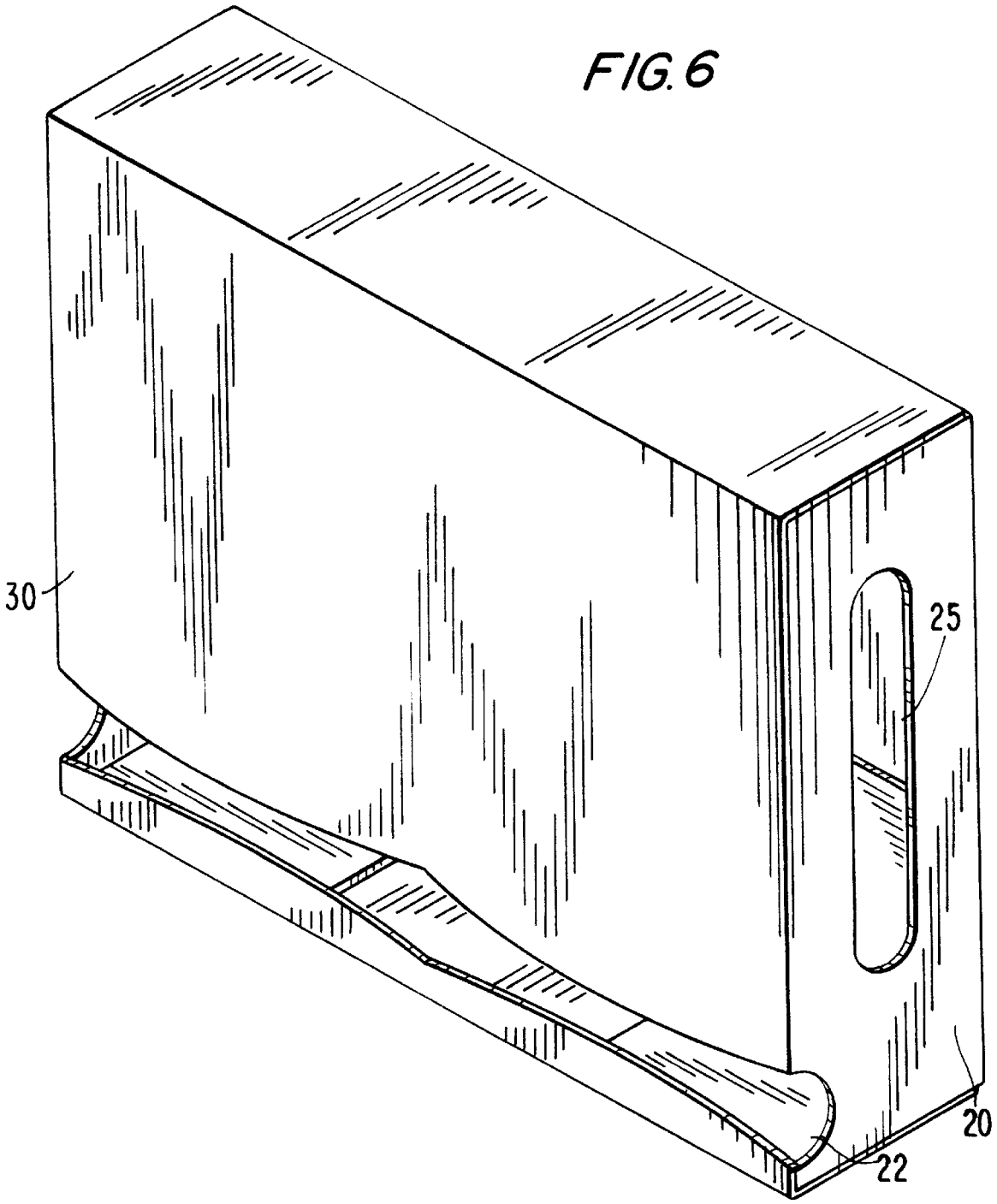
FIGS. 6–8 are perspective views of further embodiment.
Figure 7:
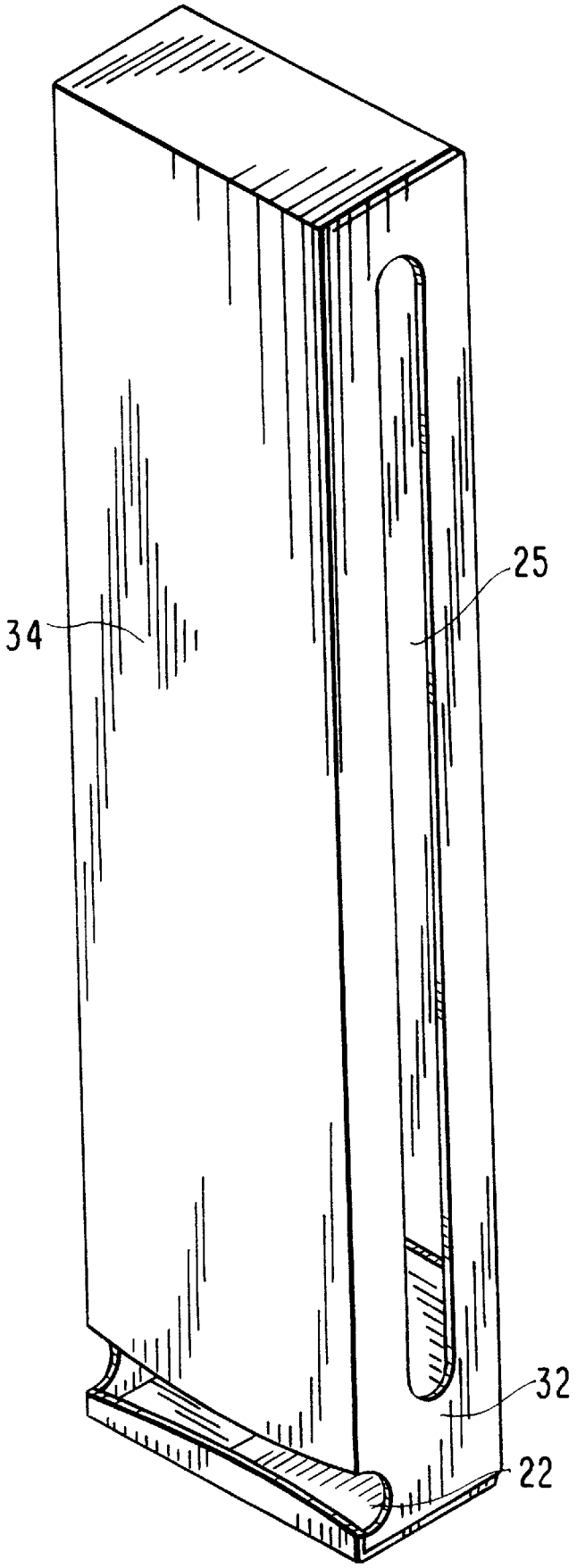
Figure 8:
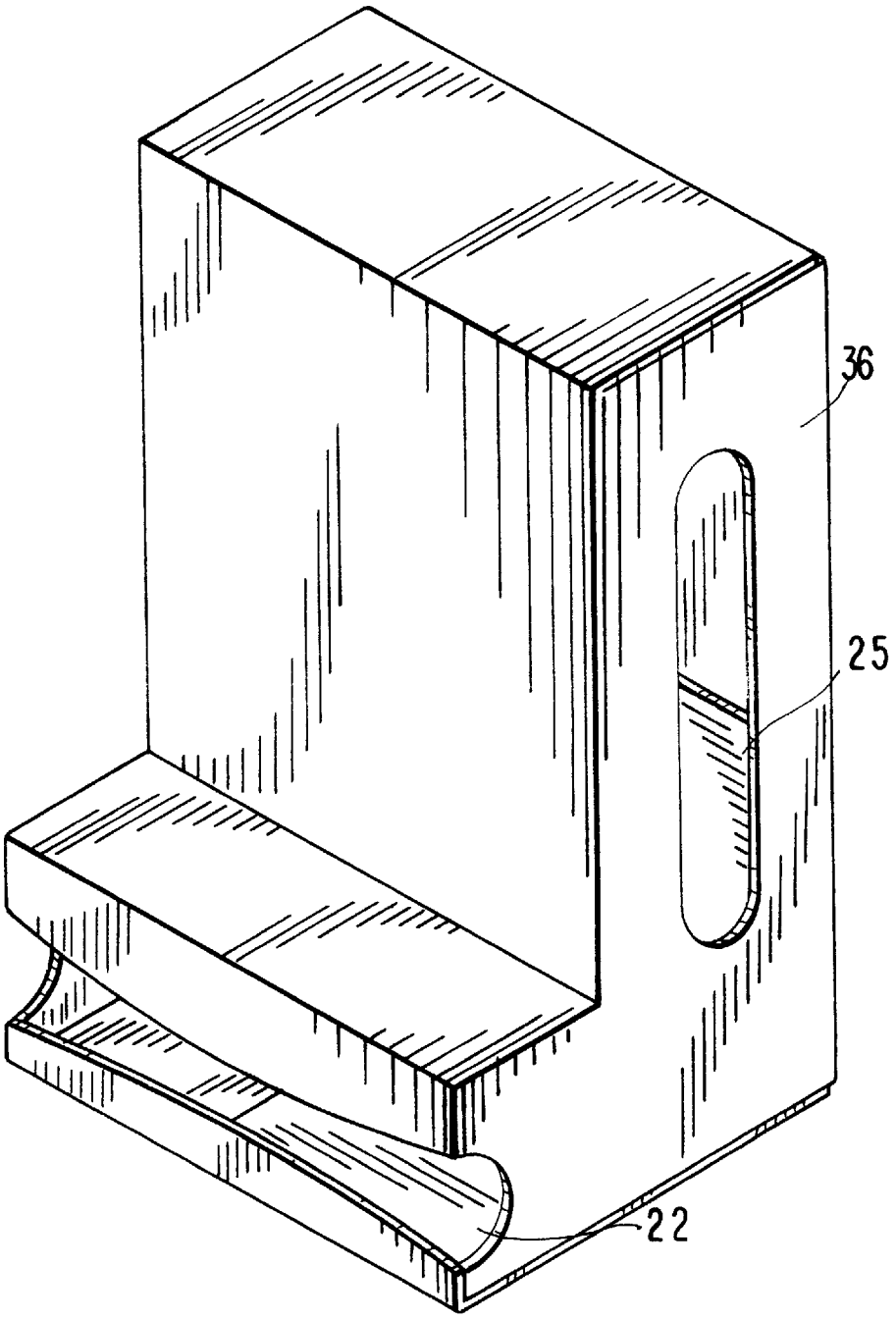

FIGS. 6 and 7 show further embodiments in which the width or height of the dispenser is doubled to accommodate additional batteries. FIG. 8 shows the dispenser having an L-shape configuration to accommodate the bulk of the batteries towards the back away from the dispenser aperture.

Figure 9:
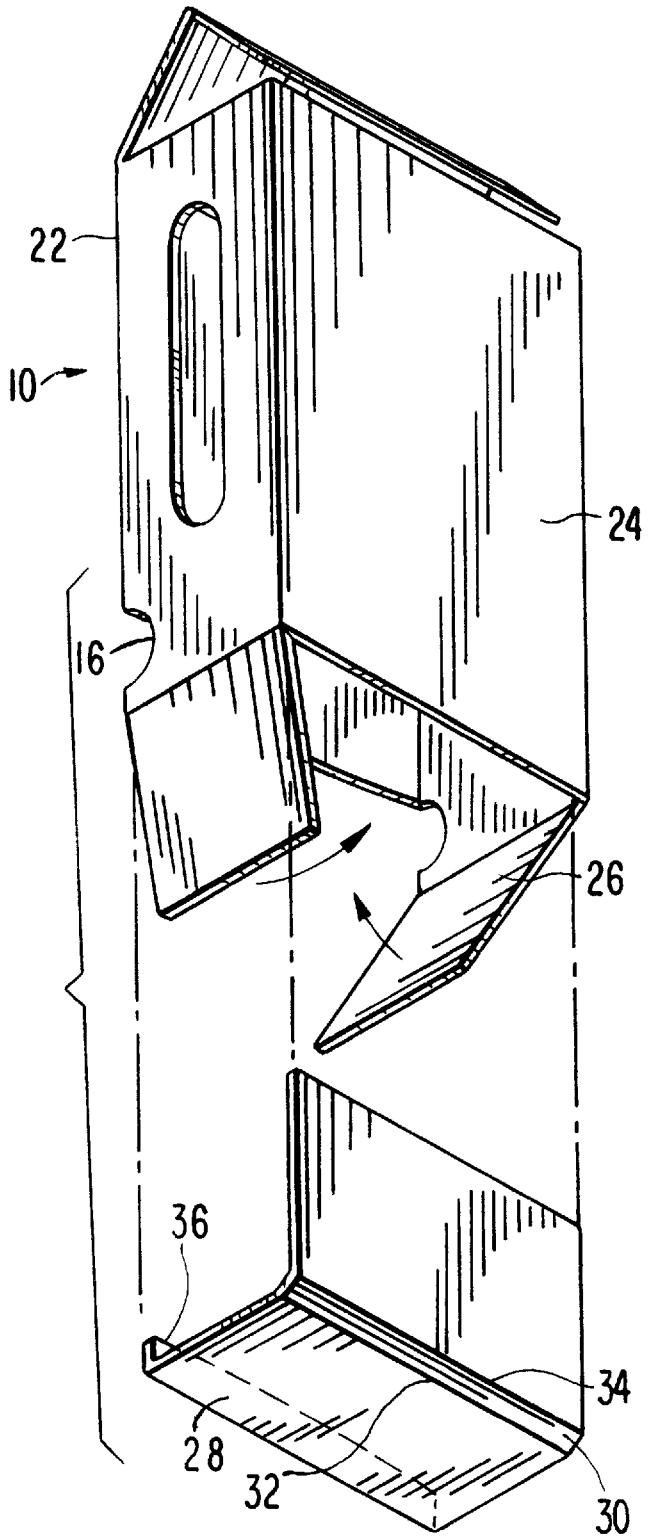
FIG. 9 is an exploded perspective view showing the assembly of the dispenser.

FIG. 9 shows and further embodiment in which the dispenser 10 is of two components. The first is a box 24 with flaps 26 at the bottom. The aperture 16 is present. The second component is an insert that includes a bottom cover 28, a creased segment 30 between creases 32, 34, a curved edge portion 36 that defines part of the aperture 16 when assembled, and a retaining portion 38.

To assemble, the flaps 24 are closed and the retaining portion 38 is inserted through the slit defined by the flaps with the rear side of the box 24 until the creased segment 30 is inserted as well. The crease 34 causes the bottom cover to fit over the flaps and the curved edge portion 36 wraps to the front side of the box 22, defining the bottom half of the aperture 16. Tape or some other adhesive may be applied to keep the curved edge portion 36 in position.

As an alternative, the embodiments of FIGS. 1–8 do not need the insert 28. Instead, a conventional box is simply cut to define the aperture 22 in the front and adjoining sidewalls. The bottom of the box need not be opened and so does not require its own lid.

In all the embodiments, the dispenser may be constructed of cardboard, wood, plastic, metal or any other sturdy material. If plastic, the dispenser may be transparent. As may be appreciate from the differences in the embodiments of FIGS. 1 and 7–9, the dispenser may be of any size, such as a 4-pack or 12-pack of batteries. Also, the lid 12 may be so attached to a different one of the top edges and thereby swing open about that edge instead.

Cellophane or another type of plastic wrap is wrapped around the container to prevent removal of the batteries while the container is on a store shelf or hanging from a display rod for purchase. By making the container or box itself transparent, however, the consumer and merchant can see at the time of purchase just how many batteries are within the container or box.

While the foregoing description and drawings represent the preferred embodiments of the present invention, it will be understood that various changes and modifications may be made without departing from the spirit and scope of the present invention.

What is claimed is:

1. A battery-filled container, comprising;

a plurality of batteries; and a box containing the batteries in a stacked manner, the box having a top edge, a face, and sidewalls adjacent opposite sides of the face, the face having two edges each convexly curved and extending between the sidewalls and defining an aperture between the two edges, the sidewalls each having a recess adjacent to and in spatial communication with the aperture, the aperture defining a spacing between a portion of the two edges that is smaller in dimension than a diameter of any one of the batteries contained within the container, the face flexing in response to a concentration of manual forces being applied to one of the two edges so as to in effect widen the aperture to permit the batteries to emerge through the aperture one at a time.

2. A container as in claim 1, further comprising plastic wrapped around said box.

3. A container as in claim 1, wherein said container has a plurality of walls, at least one of said walls being transparent.

4. A method of dispensing batteries one at a time from a container, comprising the steps of:

grasping ends of a battery through recesses of a container, the container having a face with two edges that are each convexly curved and extend between sidewalls of the container and that define an aperture therebetween, the aperture defining a spacing smaller in dimension than a diameter of the grasped battery, the recesses being adjacent to and in spatial communication with the aperture;

pulling the grasped battery outwardly to flex one of the edges by a concentration of manual forces so as to in effect widen the aperture;

removing the grasped battery from within the container through the widened aperture in the direction of the pulling; and filling a void left by the removed battery with another battery by a force of gravity.

5. A container as in claim 1, wherein the batteries are each either AA type or AAA type.

* * * * *